US007389984B2

(12) United States Patent
Tsai

(10) Patent No.: US 7,389,984 B2
(45) Date of Patent: Jun. 24, 2008

(54) WIDTH-ADJUSTABLE SHEET TRAY

(75) Inventor: Chih Jen Tsai, Taitung (TW)

(73) Assignee: Avision Inc. (TW)

( * ) Notice: Subject to any disclaimer, the term of this patent is extended or adjusted under 35 U.S.C. 154(b) by 118 days.

(21) Appl. No.: 11/431,620

(22) Filed: May 11, 2006

(65) Prior Publication Data

US 2006/0255532 A1 Nov. 16, 2006

(51) Int. Cl.
*B65H 1/00* (2006.01)

(52) U.S. Cl. ..... 271/171; 271/145

(58) Field of Classification Search ..... 271/171, 271/145; 399/393
See application file for complete search history.

(56) References Cited

U.S. PATENT DOCUMENTS 4,275,878 A * 6/1981 Ruschepaul ..... 271/170
4,907,792 A * 3/1990 Washiashi et al. ..... 271/240
6,315,285 B1 * 11/2001 Brugger et al. ..... 271/145
2003/0075858 A1 * 4/2003 Vedoy ..... 271/171
2006/0113725 A1 * 6/2006 Ito ..... 271/171

* cited by examiner

*Primary Examiner*—Patrick Mackey
*Assistant Examiner*—Luis A Gonzalez

(57) ABSTRACT

A width-adjustable sheet tray includes a sheet supporting part, left and right rollers, a ring-shaped flexible transmission component, and left and right guiding components. The supporting part has left and right guiding slots. The left and right rollers are attached to a backside of the supporting part. A line connecting rotation centers of the left and right rollers is defined as a central line. The transmission component surrounds the left roller and the right roller and includes first and second portions on opposite sides of the central line. The left guiding component passing through the left guiding slot is fixed to the first portion. The right guiding component passing through the right guiding slot is fixed to the second portion. Thus, the left and right guiding components can be moved close to and away from each other through the transmission component so as to hold and guide the sheets.

6 Claims, 6 Drawing Sheets

WIDTH-ADJUSTABLE SHEET TRAY

BACKGROUND OF THE INVENTION

1. Field of the Invention

The invention relates to a width-adjustable sheet tray, and more particularly to a width-adjustable sheet tray with a minimized sheet holding width using a belt to adjust the width.

2. Description of the Related Art

Automatic document feeders are widely used in scanners, printers and multi-function peripherals. The sheets to be placed in the automatic document feeder are typically determined by a user. So, the automatic document feeder is usually equipped with a left guiding component and a right guiding component for holding and guiding the sheets such that the user can manually make an adjustment according to the width of the sheet and the skew of the sheet being fed may be avoided.

The sheet width adjusting mechanism of a conventional automatic document feeder is usually composed of a gear and two racks, which are located at two sides of the gear and engage with the gear. When the user moves the left guiding component, the gear is rotated to move the right guiding component. Thus, the left guiding component and the right guiding component may be moved close to or away from each other synchronously.

The minimum width of the sheet that can be held and guided by the sheet width adjusting mechanism is restricted by the structures of the gear, the left guiding component and the right guiding component. Thus, the sheet, such as a long invoice having the width smaller than the minimum width, cannot be held and guided by the left guiding component and the right guiding component.

In addition, because the rack needs an elastic rib to press against the sliding slot, the rack does not pertain to the standard element, and the manufacturer has to additionally order the racks satisfying the requirement, and the manufacturing cost cannot be reduced.

SUMMARY OF THE INVENTION

It is therefore an object of the invention to provide a width-adjustable sheet tray using a belt to adjust the width such that the width of the sheet that can be held can be minimized.

To achieve the above-identified object, the invention provides a width-adjustable sheet tray including a sheet supporting part, a left roller, a right roller, a ring-shaped flexible transmission component, a left guiding component and a right guiding component. The sheet supporting part has a front side to be in contact with a sheet, a backside opposite to the front side, and a left guiding slot and a right guiding slot both penetrating through the sheet supporting part from the front side to the backside. The left roller and the right roller are attached to the backside. A line connecting rotation centers of the left roller and the right roller is defined as a central line. The ring-shaped flexible transmission component surrounds the left roller and the right roller and includes a first portion and a second portion located on opposite sides of the central line. The left guiding component passes through the left guiding slot and is fixed to the first portion of the flexible transmission component. The right guiding component passes through the right guiding slot and is fixed to the second portion of the flexible transmission component, such that the left guiding component and the right guiding component can be moved close to and away from each other through the flexible transmission component so as to hold and guide the sheet.

The sheet tray may further include a sheet-surface limiter, which is fixed to the sheet supporting part and passes through the left guiding component and the right guiding component so as to prevent the sheet from separating from the front side of the sheet supporting part and to assist in guiding the left guiding component and the right guiding component to move.

DETAILED DESCRIPTION OF THE INVENTION

The sheet tray according to the embodiments of the invention will be described with reference to the accompanying drawings, wherein the same symbols denote the same elements.

Figure 1:
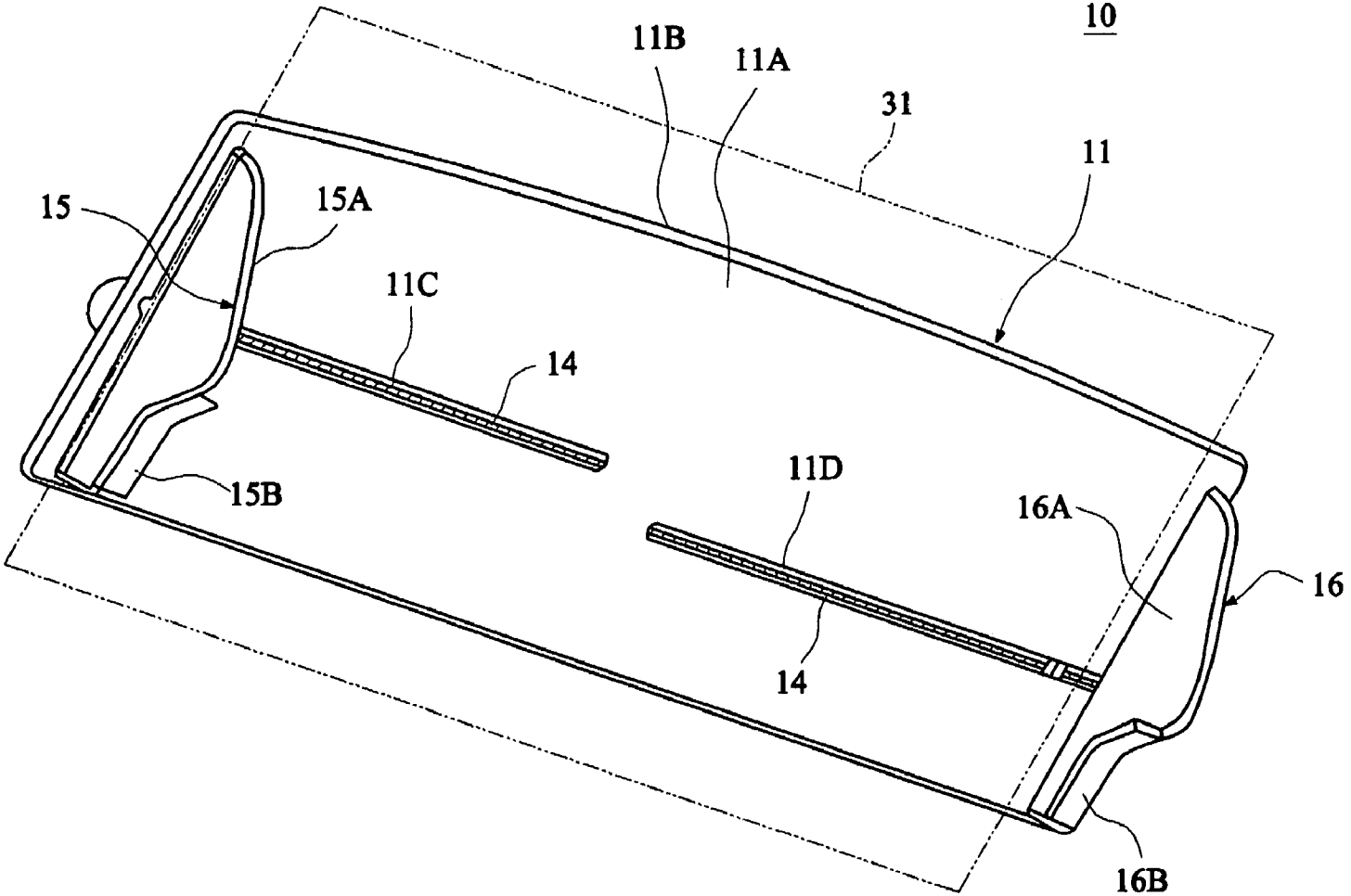
FIG. 1 is a pictorial view showing a front side of a width-adjustable sheet tray according to a first embodiment of the invention.
Figure 2:
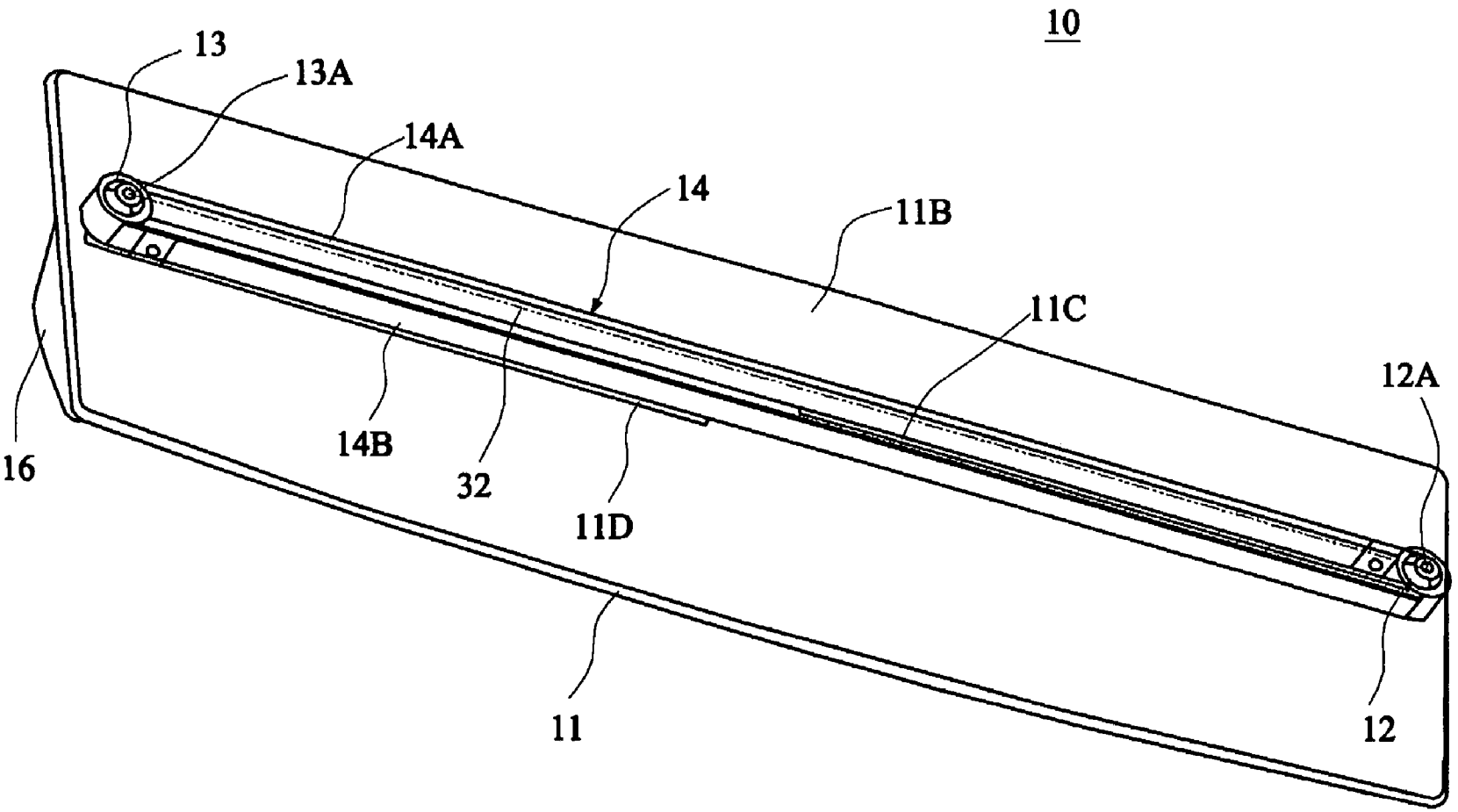
FIG. 2 is a pictorial view showing a backside of the width-adjustable sheet tray according to the first embodiment of the invention.
Figure 3:
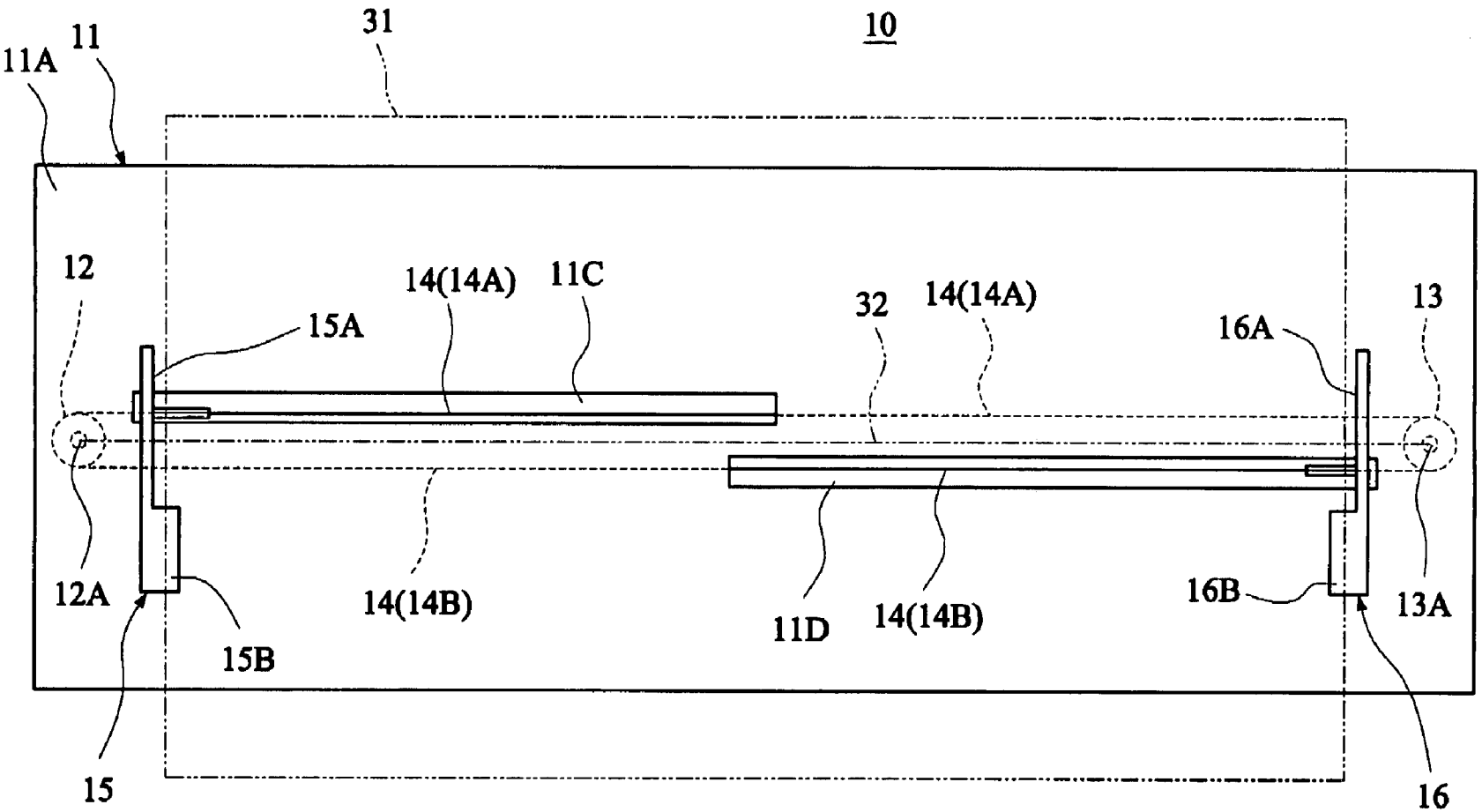
FIG. 3 is a top view showing the width-adjustable sheet tray according to the first embodiment of the invention.
Figure 4:
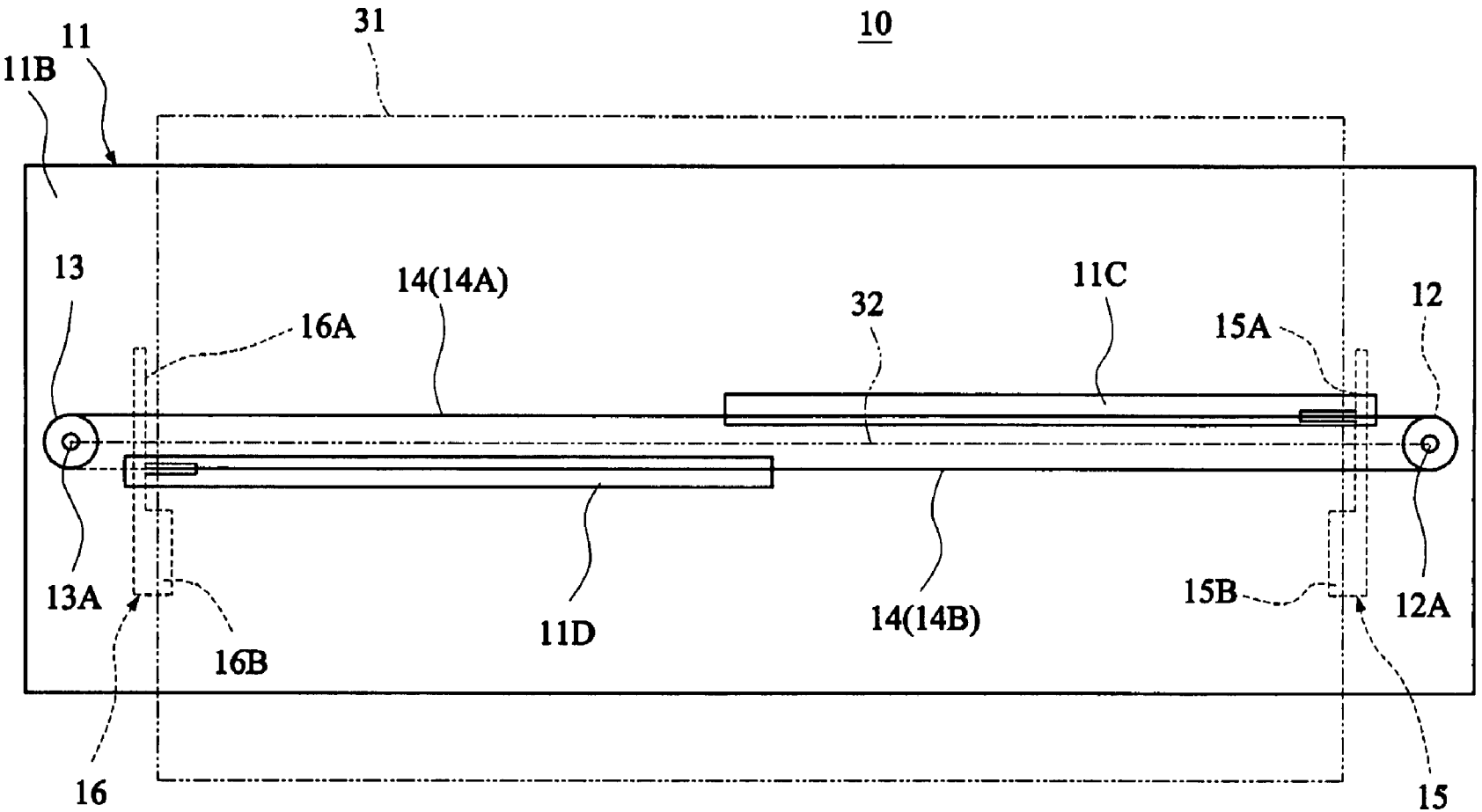
FIG. 4 is a bottom view showing the width-adjustable sheet tray according to the first embodiment of the invention.

FIGS. 1 and 2 are pictorial views showing a front side and a backside of a width-adjustable sheet tray 10 according to a first embodiment of the invention, respectively. FIGS. 3 and 4 are a top view and a bottom view showing the width-adjustable sheet tray 10 according to the first embodiment of the invention, respectively. Referring to FIGS. 1 to 4, the width-adjustable sheet tray 10 with a minimized sheet holding width includes a sheet supporting part 11, a left roller 12, a right roller 13, a ring-shaped flexible transmission component 14, a left guiding component 15 and a right guiding component 16.

The sheet supporting part 11 has a front side 11A to be in contact with a sheet 31, a backside 11B opposite to the front side 11A, and a left guiding slot 11C and a right guiding slot 11D both penetrating through the sheet supporting part 11 from the front side 11A to the backside 11B.

The left roller 12 and the right roller 13 are attached to the backside 11B. The left roller 12 is located at a left side of the left guiding slot 11C, and the right roller 13 is located at a right side of the right guiding slot 11D. However, the locations of the left roller 12 and the right roller 13 are not limited thereto. Instead, the left roller 12 and the right roller 13 can be located at any positions suitable for the function of the invention. In order to facilitate the following description, a line connecting rotation centers 12A and 13A of the left roller 12 and the right roller 13 is defined as a central line 32.

The ring-shaped flexible transmission component 14 may be, for example, a belt, a timing belt or a chain, and the left and right rollers may be pulleys or sprockets. The component 14 connects the left roller 12 to the right roller 13 and includes a first portion 14A and a second portion 14B located at opposite sides of the central line 32. The left guiding component 15 passing through the left guiding slot 11C is fixed to the first portion 14A of the flexible transmission component 14. The right guiding component 16 passing through the right guiding slot 11D is fixed to the second portion 14B of the flexible transmission component 14. Consequently, the left guiding component 15 and the right guiding component 16 can be moved close to and away from each other through the flexible transmission component 14 so as to utilize a left-guiding-component plane limiter 15A and a right-guiding-component plane limiter 16A to hold and guide the sheet 31.

In this embodiment, the left guiding component 15 may also have a left sheet-surface-width limiter 15B. The right guiding component 16 may also have a right sheet-surface-width limiter 16B. Both the limiters 15B and 16B can prevent two sides of the sheet 31 from separating from the front side 11A of the sheet supporting part 11 and can also limit the number of the sheets being placed.

Figure 5:
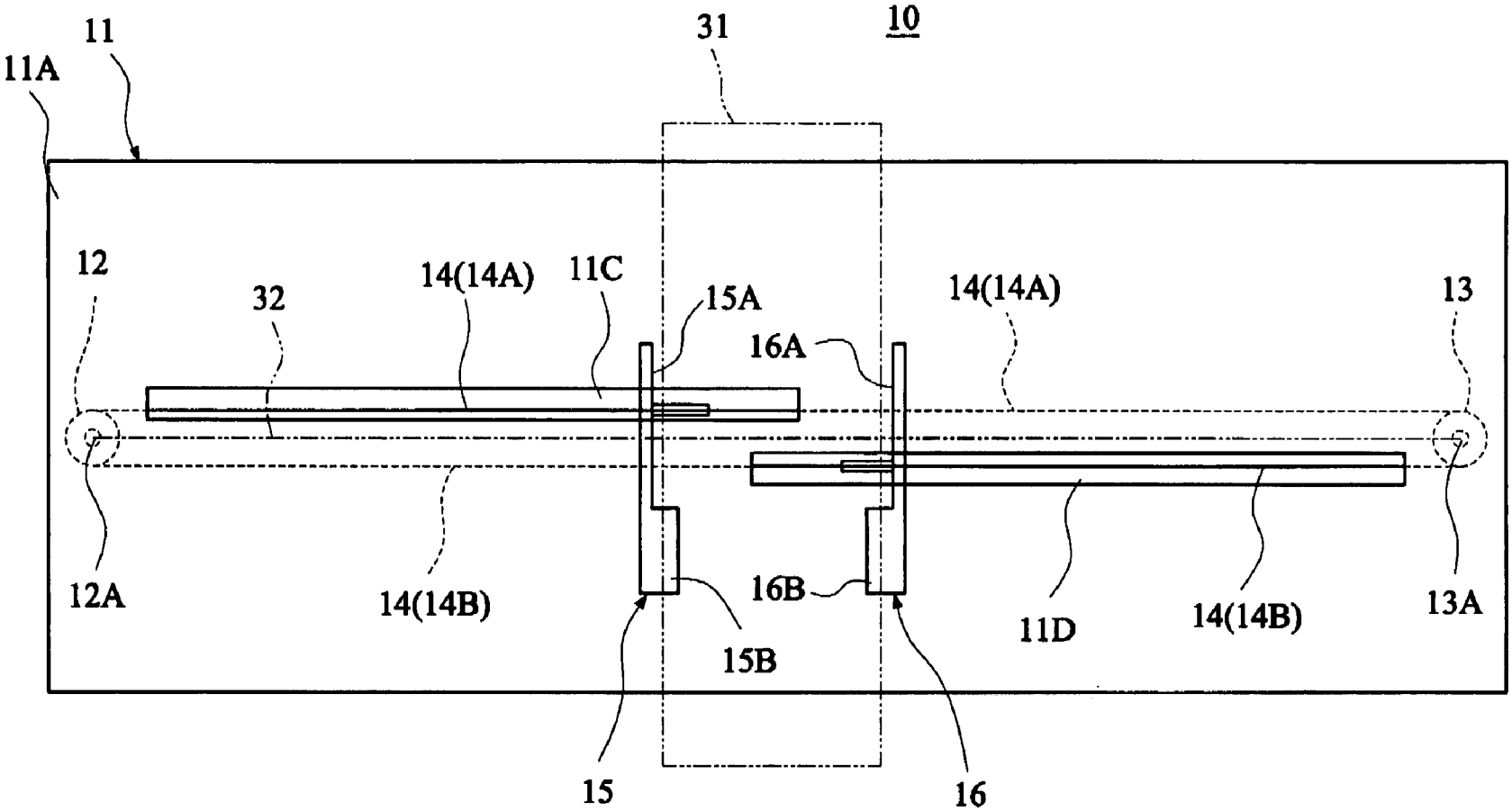
FIG. 5 is a top view showing that the width of the width-adjustable sheet tray is adjusted according to the first embodiment of the invention.

FIG. 5 is a top view showing that the width of the width-adjustable sheet tray is adjusted according to the first embodiment of the invention. As shown in FIG. 5, when the right guiding component 16 is moved leftwards, the right guiding component 16 moves the second portion 14B of the flexible transmission component 14 leftwards. At this time, the first portion 14A of the flexible transmission component 14 is moved rightwards to move the left guiding component 15 rightwards. Alternatively, when the left guiding component 15 is moved rightwards, the left guiding component 15 moves the first portion 14A of the flexible transmission component 14 rightwards. At this time, the second portion 14B of the flexible transmission component 14 is moved leftwards to move the right guiding component 16 leftwards.

Figure 6:
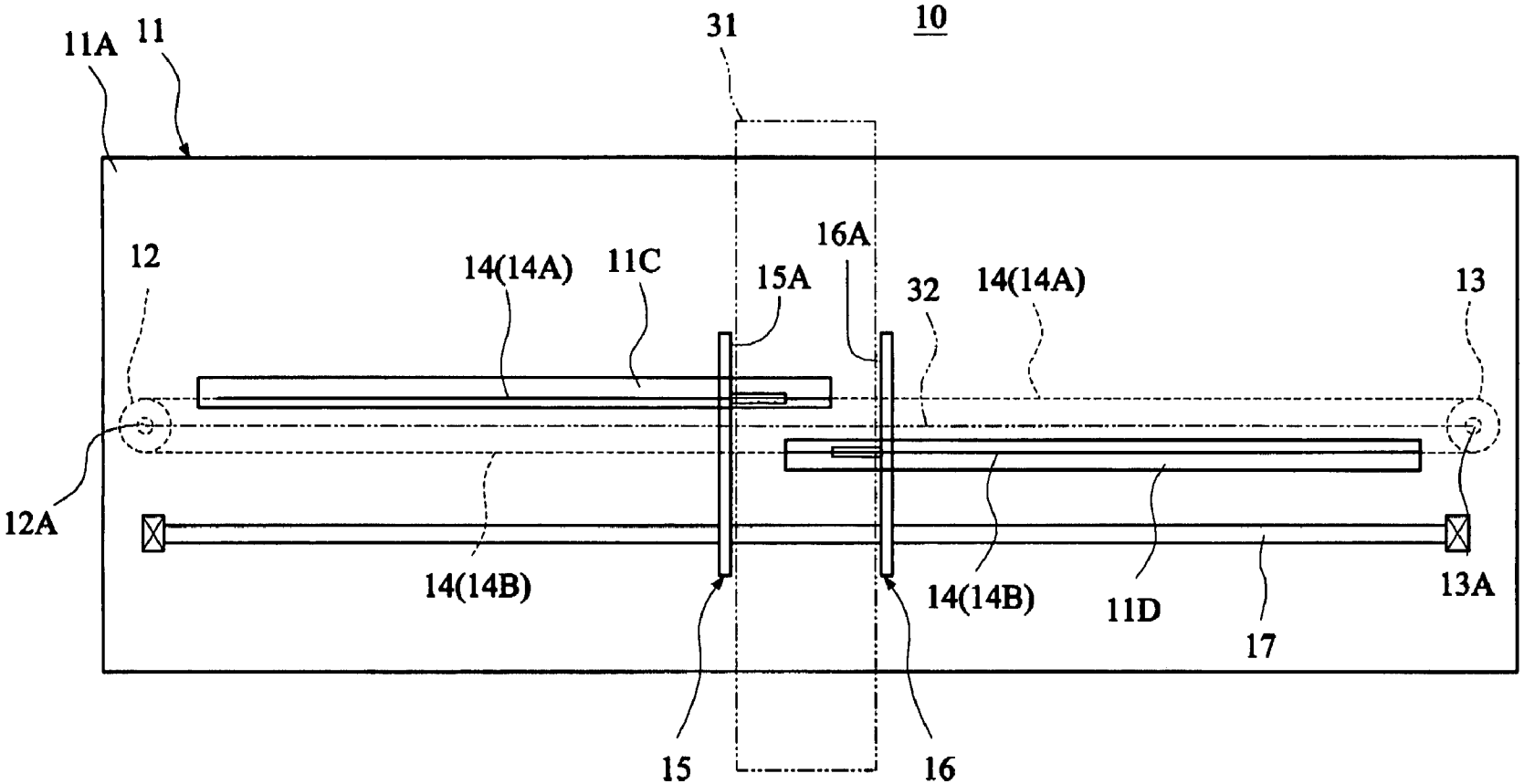
FIG. 6 is a top view showing a width-adjustable sheet tray according to a second embodiment of the invention.

FIG. 6 is a top view showing a width-adjustable sheet tray according to a second embodiment of the invention. As shown in FIG. 6, the left-guiding-component plane limiter 15A of the left guiding component 15 contacting the sheet 31 and the right-guiding-component plane limiter 16A of the right guiding component 16 contacting the sheet 31 can be moved to touch each other. That is, the minimum width of the sheet which can be held and guided by the sheet tray 10 is not particularly restricted. Alternatively, the object also may be achieved when the left sheet-surface-width limiter 15B and the right sheet-surface-width limiter 16B of the first embodiment are eliminated. In order to achieve the better state, the sheet tray 10 further includes a sheet-surface limiter 17, which is a guiding rod in this embodiment. The sheet-surface limiter 17 is fixed to the sheet supporting part 11 and passes through the left guiding component 15 and the right guiding component 16 in order to prevent the sheet 31 from separating from the front side 11A of the sheet supporting part 11 or to flatten the sheet 31, and to assist in guiding the left guiding component 15 and the right guiding component 16 to move. The pressing range of the sheet-surface limiter 17 is wider than that defined by both the left sheet-surface-width limiter 15B and the right sheet-surface-width limiter 16B in the first embodiment. It is to be noted that the sheet-surface limiter 17 may also directly replace the left sheet-surface-width limiter 15B and the right sheet-surface-width limiter 16B of the first embodiment.

According to the embodiments of the invention, the belt or the timing belt pertains to the standard element that is frequently used and can be easily available with a lower cost. In addition, the minimum width of the sheet is not particularly restricted, and the product application can be broadened. Furthermore, using the sheet-surface limiter can effectively flatten the sheet and assist in guiding the sheet to be fed by the sheet-feeding mechanism.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A width-adjustable sheet tray, comprising:

a sheet supporting part having a front side to be in contact with a sheet, a backside opposite to the front side, and a left guiding slot and a right guiding slot both penetrating through the sheet supporting part from the front side to the backside;

a left roller and a right roller, both of which are attached to the backside, wherein a line connecting rotation centers of the left roller and the right roller is defined as a central line;

a ring-shaped flexible transmission component surrounding the left roller and the right roller and comprising a first portion and a second portion located on opposite sides of the central line;

a left guiding component, which passes through the left guiding slot and is fixed to the first portion of the flexible transmission component;

a right guiding component, which passes through the right guiding slot and is fixed to the second portion of the flexible transmission component, such that the left guiding component and the right guiding component can be moved close to and away from each other through the flexible transmission component so as to hold and guide the sheet; and a sheet-surface limiter, which is fixed to the sheet supporting part and passes through the left guiding component and the right guiding component so as to prevent the sheet from separating from the front side of the sheet supporting part and to assist in guiding the left guiding component and the right guiding component to move.

2. The sheet tray according to claim 1, wherein the flexible transmission component is a belt.

3. The sheet tray according to claim 2, wherein the belt is a timing belt.

4. The sheet tray according to claim 1, wherein the flexible transmission component is a chain.

5. The sheet tray according to claim 1, wherein a left-guiding-component plane limiter of the left guiding component contacting the sheet and a right-guiding-component plane limiter of the right guiding component contacting the sheet can be moved to contact each other.

6. The sheet tray according to claim 1, wherein the sheet-surface limiter is a guiding rod.

* * * * *